US005884855A

United States Patent [19]

Chang

[11] Patent Number: 5,884,855

[45] Date of Patent: Mar. 23, 1999

[54] PAPER FEED STRUCTURE FOR PAPER SHREDDERS

[76] Inventor: Frank Chang, 5th Fl., No. 11, Sannin St., Sanchung, Taipei, Taiwan

[21] Appl. No.: 78,356

[22] Filed: May 13, 1998

[51] Int. Cl.[6] ..... B02C 25/00

[52] U.S. Cl. ..... 241/34; 241/36; 241/186.2; 241/186.4; 241/236

[58] Field of Search ..... 241/33, 34, 36, 241/185.5, 186.2, 186.35, 236, 186.4

[56] References Cited

U.S. PATENT DOCUMENTS

| | | | |
|---|---|---|---|
| 4,192,467 | 3/1980 | Hatanaka | 241/34 |
| 4,815,669 | 3/1989 | Fujii | 241/34 |
| 4,815,670 | 3/1989 | Iwai | 241/34 |
| 4,817,877 | 4/1989 | Itoh et al. | 241/34 |
| 4,821,967 | 4/1989 | Moriyama | 241/37.5 |
| 4,842,205 | 6/1989 | Araki et al. | 241/34 |
| 4,957,243 | 9/1990 | Kanagaki et al. | 241/34 |
| 5,188,301 | 2/1993 | Hasegawa | 241/33 |
| 5,318,229 | 6/1994 | Brown | 241/34 |
| 5,354,001 | 10/1994 | Hasegawa | 241/34 |
| 5,429,313 | 7/1995 | Schwelling | 241/36 |
| 5,772,129 | 6/1998 | Nishio et al. | 241/30 |

*Primary Examiner*—John M. Husar
*Attorney, Agent, or Firm*—Pro-Techtor International Services

[57] ABSTRACT

Disclosed is a paper feed structure for paper shredders and more particularly a paper feed structure having a paper bearing device and paper feed adjustment device. The paper feed structure includes oblique paper bearing plate disposed above wheel cutters of the paper shredder, a paper feed adjustment device, an infrared shielded switch having the function of actuating the paper shredder, a paper feed roller, and slidable plates. Paper need not be fed one by one into the paper shredder manually, and the paper feed amount is adjustable. A pile of paper can be placed on the paper bearing device and the paper is automatically fed into the paper shredder one by one.

3 Claims, 4 Drawing Sheets

PAPER FEED STRUCTURE FOR PAPER SHREDDERS

BACKGROUND OF THE INVENTION (a) Field of the Invention

The present invention relates generally to a paper shredder, and more particularly to a paper feed structure for paper shredders, in which a pile of paper can be placed on a paper bearing device and is fed automatically into the paper shredder one by one.

(b) Description of the Prior Art

Paper shredders are used to destroy data, patterns, etc., on sheets of paper. They achieve their intended object by utilizing two wheel cutters having shear force. The fed paper is cut into numerous strips by the cutters. As confidential documents have to be destroyed when discarded, paper shredders have become office prerequisites.

A conventional paper shredder can only cut a single or a limited number of sheets of paper. If it is necessary to destroy a pile of documents, the user has to feed the sheets one or several at a time, and each feed can only proceed after the previously fed paper has been completely shredded. This is very time-consuming. In today's society where efficiency and productivity are of utmost importance, having an employee sitting by the paper shredder just to shred a pile of unwanted documents is very backward.

It is therefore obvious that conventional paper shredders lack a kind of automatic paper feed structure. Unlike photocopiers, facsimile machines, or computer printers in which a sheet of paper is fed each time, paper shredders allow the feeding of one or more sheets of paper. In designing an automatic paper feed structure for paper shredders, consideration has to be given to the adjustment of paper feed, the provision of switch means that is operable by the feeding of paper, and the paper bearing structure for supporting a pile of paper. The paper feed structure should also allow adjustment of the feed slot according to the amount of paper to be fed so that a large pile of paper can be automatically shredded within a short time.

SUMMARY OF THE INVENTION

A primary object of the present invention is to provide a paper feed structure for paper shredders, in which a pile of paper can be placed on a paper bearing structure and the sheets of paper can be automatically fed into the paper shredder one by one without human supervision.

Another object of the present invention is to provide a paper feed structure for paper shredders, in which an adjustment device is provided to cooperate with a wheel cutter structure so as to allow adjustment of the paper shredding efficiency to adapt to different needs.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
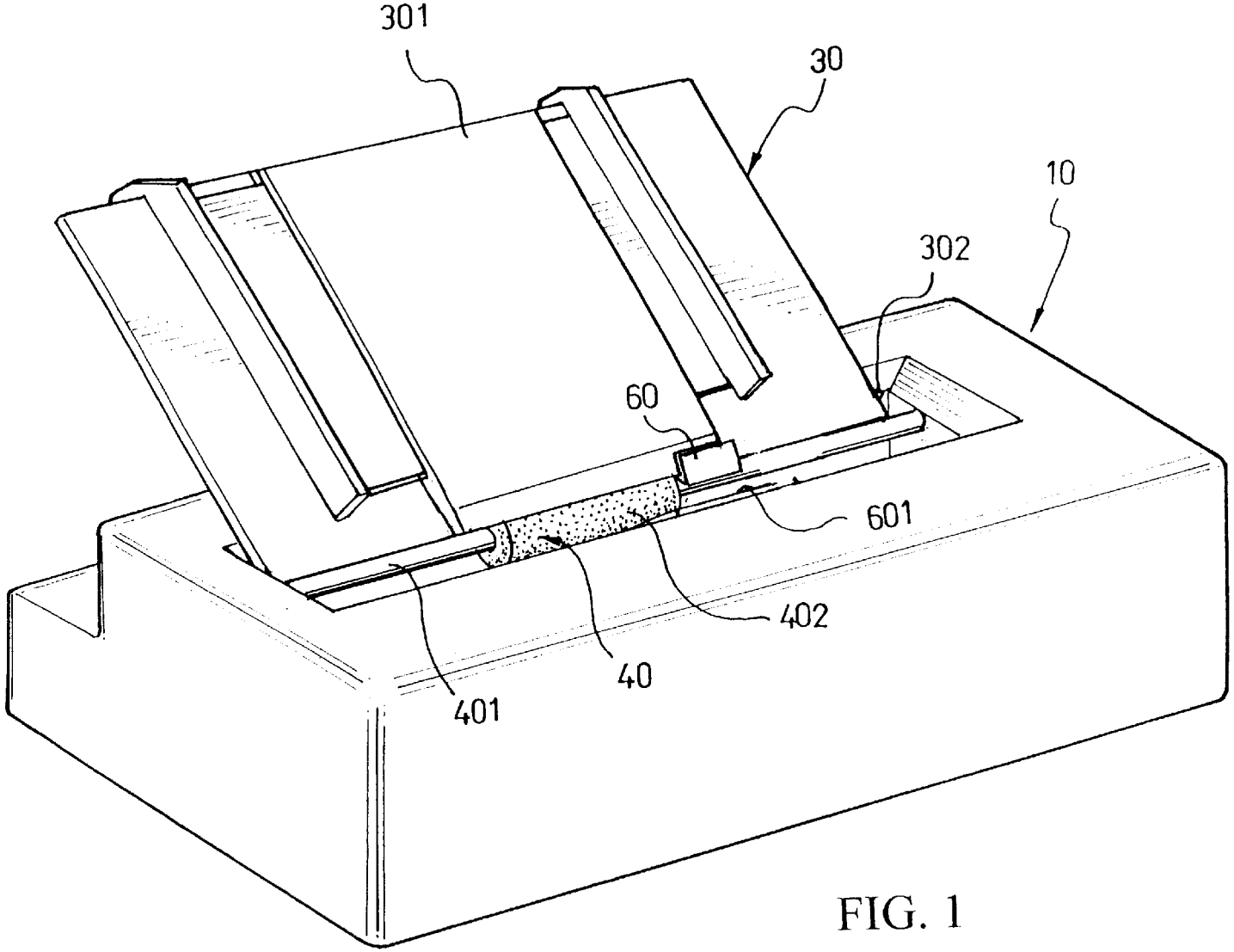
FIG. 1 is a perspective assembled view of the present invention.
Figure 2:
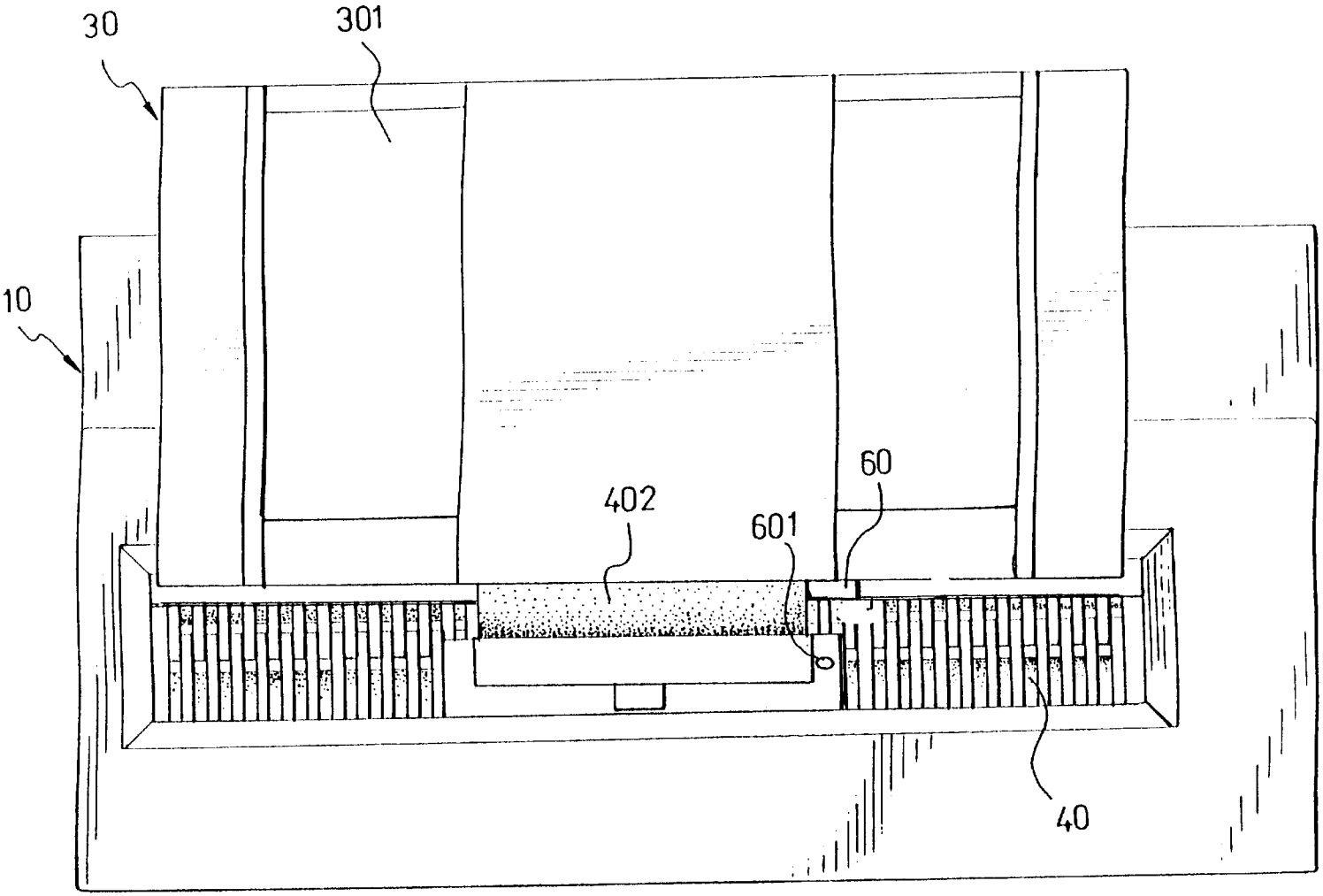
FIG. 2 is a top plan view of the present invention.

The present invention is directed to a paper feed structure for paper shredders. Referring to FIGS. 1 and 2, the present invention comprises a base 10, a wheel cutter set 20, a paper bearing device 30, a paper feed roller 40, an adjustment device 50, and an actuating device 60.

The base 10 accommodates therein a housing 101 for mounting and positioning all components. It essentially houses the wheel cutter set 20 and has a top portion 102 where the paper bearing device 30, the paper feed roller 40, the adjustment device 50, and the actuating device 60 are mounted.

The wheel cutter set 20 is comprised of two juxtaposed wheel cutters 203, each of which is provided with multiple blades 204 spaced apart by partition rings. Each blade is provided with a plurality of radial pointed teeth 201. The blades 204 of the respective wheel cutters 203 are engageable with each other to accomplish a shear force on fed paper. A vertical guide slot 202 is provided right above the middle between the two wheel cutters 203.

The paper bearing device 30 is obliquely provided at the upper side of the base 10 by means of a support shaft 302. The paper bearing device 30 receives a pile of paper to be shredded, and each sheet of paper can automatically enter the paper shredder. An adjustment seat 301 is provided on the paper bearing device 30 to guide paper in and further includes guide plates to allow adjustment at one side of both sides thereof according to the size of the paper to be shredded.

The paper feed roller 40 is supported at the lower rim of the paper bearing device 30 and includes a rotary shaft 401 driven by electric power. A section of the rotary shaft 401 is provided with a rubber roller 402 having good friction. Rotation of the roller 402 can move the bottom sides of the sheets of paper on the paper bearing device 40 and thereby pull the sheets downwardly.

Figure 4:
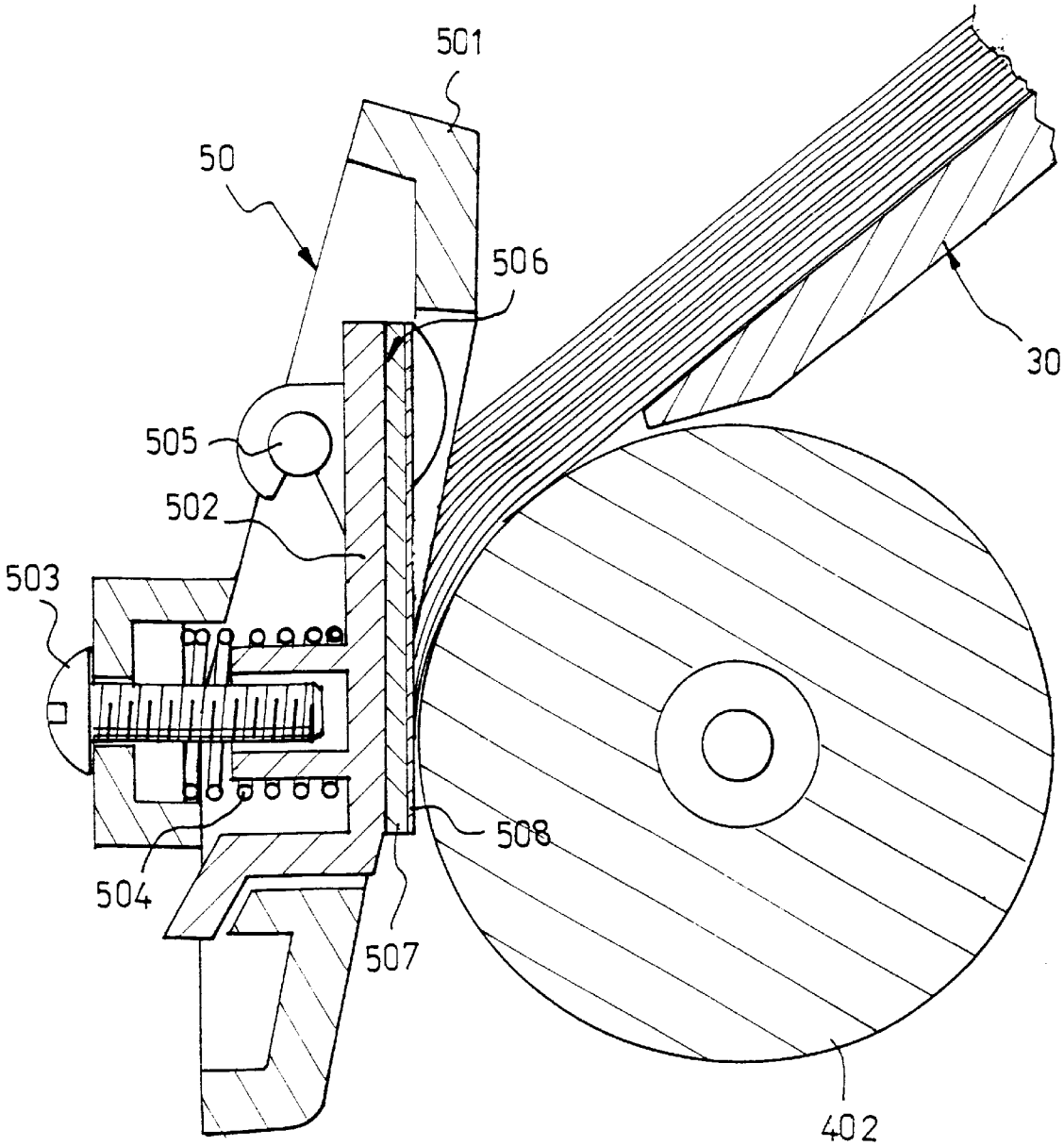
FIG. 4 is a detailed sectional view of the adjustment device of the present invention.

The adjustment device 50 is provided at the side opposite to the roller 402. As shown in FIG. 4, it includes a substrate 501 which has a hollow portion, a clamp plate 502 disposed in the hollow portion, a spindle 505 passing through an upper end of the clamp plate 502 to secure it to the substrate 501, an adjustment button 503 extending through the substrate 501, and a spring 504 fitted on the adjustment button 503 and urging against a lower portion of the clamp plate 502 to allow the adjustment button 503 to advance or retrieve, thus enabling a screw rod and the spring 504 to push the clamp plate 502 to advance or retrieve to change a clearance between the clamp plate 502 and the roller 402. The clearance determines the amount of paper feed at each operation.

A soft and smooth face plate 506 is coupled to that side of the clamp plate 502 relative to the roller 402. The face plate 506 includes an inner layer of soft rubber or foamed soft layer 507 and a surface layer of smooth metal laminate 508. The face plate 506 contacts the paper and has good elasticity and smoothness as well as wear resistance.

Figure 3:
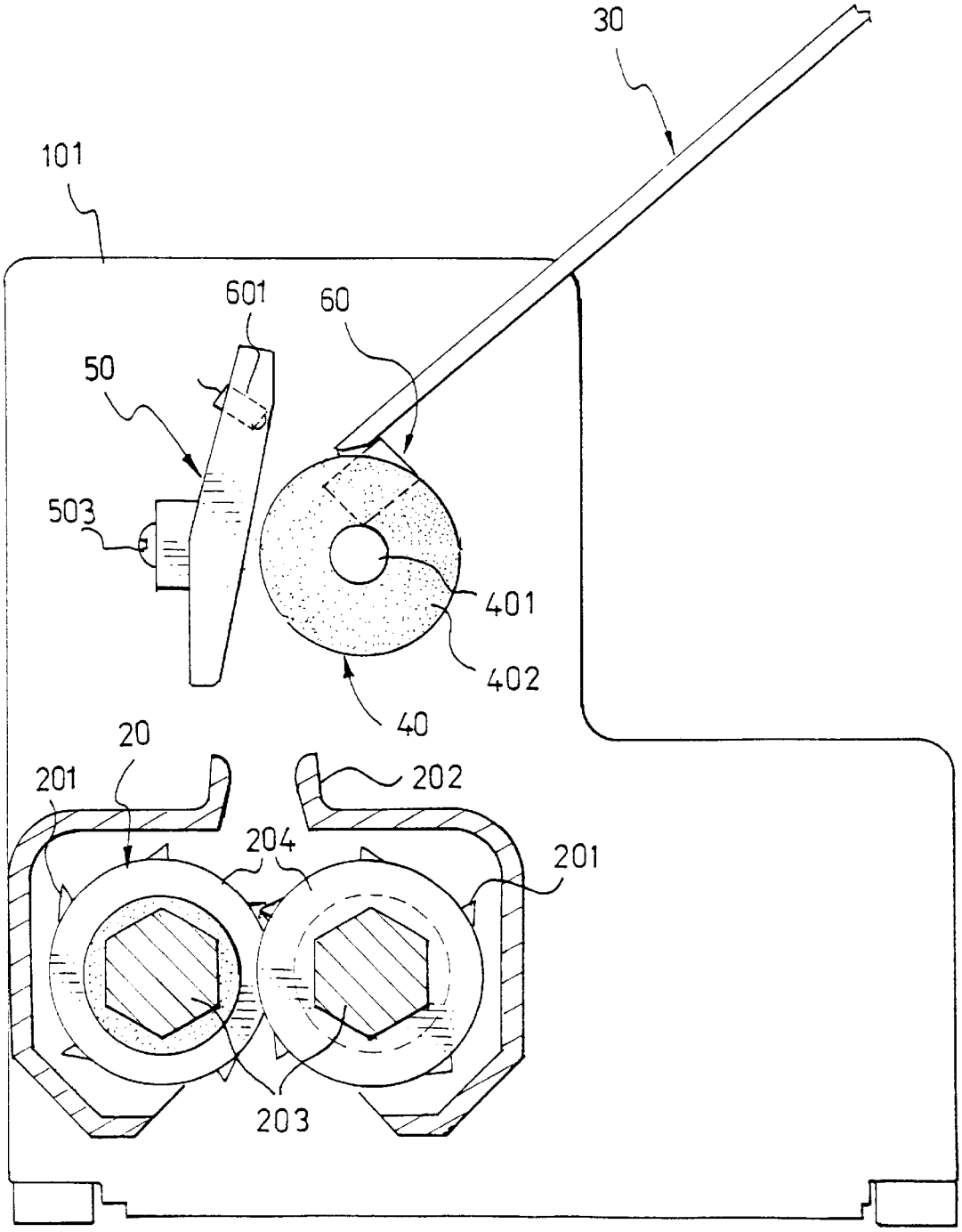
FIG. 3 is a side sectional view of the present invention.

The actuating device 60 is mounted below the paper slot, as shown in FIG. 3, i.e., on the surface of the adjustment device 50. It includes an infrared shielded switch 601. When paper is placed on the paper bearing device, the lower rim of the paper will block the infrared so that the operating power supply is connected to actuate the paper shredder.

Although the present invention has been illustrated and described with reference to the preferred embodiment thereof, it should be understood that it is in no way limited to the details of such embodiment but is capable of numerous modifications within the scope of the appended claims.

What is claimed is:

1. A paper feed structure for paper shredders, comprising a base, a wheel cutter set, a paper bearing device, a paper feed roller, an adjustment device, and an actuating device, wherein said base includes a housing in which said wheel cutter set is housed, said base further having a top portion on which are mounted said paper bearing device, said paper feed roller, said adjustment device, and said actuating device;

said wheel cutter set is comprised of two juxtaposed wheel cutters, each of which is provided with a plurality of blades spaced apart by partition rings, each blade being provided with a plurality of radial pointed teeth, said blades of said respective wheel cutters being engageable with each other to accomplish a shear force on fed paper;

said paper bearing device is obliquely provided at the upper side of said base by means of a support shaft thereof, said paper bearing device receiving a pile of paper to be shredded to allow each sheet of paper to automatically enter the paper shredder, said paper bearing device including an adjustment seat to guide paper in and guide plates to allow adjustment at one side of both sides thereof according to the size of the paper to be shredded;

said paper feed roller is supported at the lower rim of said paper bearing device and includes a rotary shaft, a section of said rotary shaft being provided with a rubber roller having good friction, rotation of said roller being utilized to move the bottom sides of the sheets of paper on said paper bearing device and to thereby pull the sheets downwardly;

said adjustment device is provided at the side opposite to said roller and includes a substrate which has a hollow portion, a clamp plate disposed in the hollow portion, a spindle passing through an upper end of said clamp plate to secure it to said substrate, an adjustment button extending through said substrate, and a spring fitted on said adjustment button and urging against a lower portion of said clamp plate to allow said adjustment button to advance or retrieve, thus enabling a screw rod and said spring to push said clamp plate to advance or retrieve to change a clearance between said clamp plate and said roller, said clearance determining the amount of paper feed at each operation;

said actuating device is mounted below a paper feed slot on the surface of said adjustment device and includes an infrared shielded switch such that when paper is placed on said paper bearing device, the lower rim of the paper will block the infrared so that the operating power supply is connected to actuate the paper shredder.

2. A paper feed structure for paper shredders as defined in claim 1, wherein a soft and smooth face plate is coupled to that side of said clamp plate relative to said roller, said face plate including an inner layer of soft rubber or foamed soft layer and a surface layer of smooth metal laminate, said face plate contacting the paper and has good elasticity and smoothness as well as wear resistance.

3. A paper feed structure for paper shredders as defined in claim 1, wherein a vertical guide slot is provided right above the middle between said two wheel cutters.

* * * * *